US011840414B2

(12) United States Patent
Deppisch et al.

(10) Patent No.: US 11,840,414 B2
(45) Date of Patent: Dec. 12, 2023

(54) ROLL UNWINDER, WEB-FED PRINTING PRESS, AND METHOD FOR OPERATING A ROLL UNWINDER

(71) Applicant: KOENIG & BAUER AG, Würzburg (DE)

(72) Inventors: Bastian Deppisch, Karlstadt (DE); Walter Ritter, Grünsfeld (DE); Michael Schmitt, Erlabrunn (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 18/011,910

(22) PCT Filed: Mar. 12, 2021

(86) PCT No.: PCT/EP2021/056333
§ 371 (c)(1),
(2) Date: Dec. 21, 2022

(87) PCT Pub. No.: WO2022/008106
PCT Pub. Date: Jan. 13, 2022

(65) Prior Publication Data

US 2023/0192431 A1 Jun. 22, 2023

(30) Foreign Application Priority Data

Jul. 8, 2020 (DE) ..... 10 2020 118 023.3

(51) Int. Cl.
*B65H 19/20* (2006.01)
*B65H 19/18* (2006.01)
*B41J 15/16* (2006.01)

(52) U.S. Cl.
CPC ..... *B65H 19/181* (2013.01); *B41J 15/16* (2013.01); *B65H 19/20* (2013.01);
(Continued)

(58) Field of Classification Search
CPC ..... B65H 19/20; B65H 19/181; B65H 2404/693; B41J 15/16
See application file for complete search history.

(56) References Cited

U.S. PATENT DOCUMENTS 3,904,142 A 9/1975 Corse et al.
3,944,151 A * 3/1976 Lee ..... B65H 19/20 242/555.6

(Continued)

FOREIGN PATENT DOCUMENTS

DE 102006014964 A1 10/2007
DE 102008000242 B3 1/2009

(Continued)

OTHER PUBLICATIONS

International Search Report of PCT/EP2021/056333 dated Jun. 29, 2021.

*Primary Examiner* — Sang K Kim
(74) *Attorney, Agent, or Firm* — Mattingly & Malur, PC

(57) ABSTRACT

In some examples, a roll unwinder for a flying roll change includes a roll station for receiving a first material roll to be unwound, and a roll station for receiving a second material roll to be unwound after a roll change has occurred. A cut-off tool can sever a first web unwound from the first material roll, and includes a pressing element, to press the web against the outer surface of the second material roll. A supporting device can be transferred from an idle state into a working state in which the supporting device supports the web to be unwound, at least at the time of the severing process. The supporting device supports the web in a web path upstream from the cut-off tool. A receiving unit at a frame that carries the cut-off tool is movably mounted in the stand of the roll unwinder.

11 Claims, 4 Drawing Sheets

(52) U.S. Cl.
CPC ..... *B65H 2301/46154* (2013.01); *B65H 2301/46172* (2013.01); *B65H 2404/693* (2013.01)

(56) References Cited

U.S. PATENT DOCUMENTS 4,286,756 A * 9/1981 Vits ..... B65H 19/20
242/555.6
7,971,821 B2 * 7/2011 Oelen ..... B65H 19/181
242/555.3

FOREIGN PATENT DOCUMENTS

DE 102013219259 A1 3/2015
EP 0010869 A1 5/1980
EP 1216942 A2 6/2002

* cited by examiner

ROLL UNWINDER, WEB-FED PRINTING PRESS, AND METHOD FOR OPERATING A ROLL UNWINDER

CROSS-REFERENCES TO RELATED APPLICATIONS

This application is the US national phase, under 35 USC § 371, of PCT/EP2021/056333, filed on Mar. 12, 2021, published as WO 2022/008106 A1 on Jan. 13, 2022, and claiming priority to DE 10 2020 118 023.3, filed Jul. 8, 2020, the disclosures of which are expressly incorporated by reference herein in their entireties.

TECHNICAL FIELD

Examples herein relate to a roll unwinder, to a web-fed printing press comprising a roll unwinder, and to a method for operating a roll unwinder. For instance, a roll unwinder for a flying roll change may include at least one roll station for receiving a first material roll currently to be unwound and a roll station for receiving a second material roll to be unwound after a roll change has occurred. A cut-off tool may be provided by which a first web unwound from the first material roll can be severed. A pressing element is also included, and by which the first web currently to be unwound can be pressed against the outer surface of the second material roll. A supporting device can be transferred from an idle state into a working state in which the supporting device supports the web currently to be unwound, at least at the time of the severing process, in the area of the web path at a site that is situated in the web path between the first material roll to be unwound and the location at which the pressing element cooperates with the web. The supporting device may include a supporting element, which can be moved from an idle position, which is assumed in the idle state of the supporting device, into an operative position, which is assumed in the working state of the supporting device, and in which the supporting element is situated in a relative position, which differs from the idle position, with respect to the axis of rotation of the first material roll and/or is situated in a position in which the web is supported in the web path section between the pressing element and the material roll or a next or only diverting element that is possibly provided upstream from the pressing element, on the web side facing away from the cut-off tool during the severing process. The supporting element, in its idle position, may be releasably arranged at a pivotable support frame carrying the first and second material rolls.

Additionally, web-fed printing press may include at least one printing unit by which a material web can be printed at least on one side in a plateless manner according to a digital printing method. The web-fed printing press may include an unwinder, which is arranged upstream from the at least one printing unit in the material web path and by which the material web to be printed can be unwound from a material roll.

Furthermore, some examples include a method for operating a roll unwinder that can be operated with a flying roll change. The material web of a roll that is currently being unwound may be pressed by a pressing element against the outer surface of a rotating second material roll to be pasted to the material roll currently being unwound. Before the material roll currently being unwound is cut off by means of a cut-off tool, a supporting element of a supporting device is moved from an idle position into an operative position in which the web is supported in the web path section between the pressing element and the material roll on the web side facing away from the cut-off tool.

BACKGROUND

A web-fed printing press is disclosed by DE 10 2013 219 259 A1, comprising at least one printing unit, by which a material web can be printed at least on one side in a plateless manner according to a digital printing method, and comprising an unwinder, which is arranged upstream from the printing unit in the material web path and by which the material web to be printed can be unwound from a material roll, wherein the unwinder is configured to receive at least two material rolls and to carry out a flying roll change.

DE 10 2008 000 242 B3 relates to a method for zero-speed web splicing by means of a roll changer configured for a flying roll change, wherein, in one of the steps, a connecting element is pivoted against the new material roll by a positioner so that the expiring web makes contact with the new roll.

A method for ascertaining an optimal time for initiating a roll change in a roll changer for rotary printing presses is known from EP 10 2006 014 964 A1.

U.S. Pat. No. 3,904,142 A relates to a roll changer for a flying roll change, comprising a support frame providing two roll stations, wherein a cutting blade of a cutting blade cylinder cooperates with a counter-blade for severing the expiring web, the counter-blade being mounted at the support frame and being placeable against the web to be severed from the web side located opposite the cutting blade.

A device for joining webs in a roll changer is known from EP 0 010 869 A1, wherein sensors recognize, on the one hand, a new roll being brought into close proximity of the position required for splicing and, on the other hand, a marker passing at the new roll. Cutting is carried out by way of a cutting blade, which operates against a counter-blade, which, however, may be dispensed with for some material. If a counter-blade is present, this is arranged at arms carrying diverting rollers, which can be pivoted about the roll stand axis.

A device for joining an expiring material web to a new material web is disclosed in EP 1 216 942 A2, wherein a blade is placed against a counter-blade, which is arranged in a stationary manner at the roll stand, above the material web to be severed when the expiring web is being cut.

Roll unwinders configured to carry out a roll change during operation, for example so-called roll changers for flying roll changes, are used to unroll a material web, web for short, and to automatically paste a new material web from a new material web roll to an expiring material web of a material web roll currently to be unrolled, roll for short. The expiring material web is moved close to the new roll, pasted to the new roll, and thereafter the old material web is cut off. The cut is carried out using a cutting blade that strikes, for example from overhead, against the material web, severing it.

The greater the thickness and strength of the material web, the more difficult it is for the cutting blade to penetrate the material web. When the force of the cutting blade is increased, the material web can partially avoid the movement of the blade, whereby the conditions during cutting can change considerably. On the other hand, the conditions present during cutting can vary considerably for the new roll for different roll diameters, since free path lengths that have differing lengths result between the roll and the cutting site when the support frame is pivoted to varying degrees, which likewise makes cutting difficult when large lengths are involved. Both effects become even more important when the thickness and/or strength of the web material increases, so that a flying roll change is frequently out of the question for high grammage material webs and/or webs made of material that is difficult to sever.

SUMMARY

An object herein is to devise a roll unwinder, a web-fed printing press comprising a roll unwinder, and a method for operating a roll unwinder.

This object is achieved in some examples by the roll unwinder including the supporting device to support the web in the working state in the web path upstream from the location at which the cut-off tool, when activated, strikes the web. Further, a receiving unit is provided at a frame that carries the cut-off tool and is movably mounted in the stand of the roll unwinder. The supporting element, which is releasably arranged at the support frame may be received by the receiving unit for an impending roll change.

Additionally, some examples include the web-fed printing press with the roll unwinder described above.

In addition, some examples, include a method for operating the roll unwinder in which the supporting element is moved into positions having differing distances with respect to the axis of rotation of the respective first material roll for differently sized rolls for the first material.

The advantages achieved with the invention are, in particular, that a high-quality cutting process can be reproducibly carried out for different material web roll sizes and/or materials and/or thicknesses and/or that it is possible to expand the use of the flying roll change also to web materials having high strength and/or thicknesses, for example to paperboard, cardboard or even coated materials, instead of or in addition to newspaper papers or papers used in commercial printing.

According to the invention, this is primarily achieved in that a device, which can in particular be transferred from an idle state into a working state, for supporting the material web to be severed, supporting device for short, is provided, which can be transferred from an idle state into a working state in which the material web currently to be unwound is supported in the area of the web path between the material roll to be unwound and a pressing element, for example a pressing roller.

A supporting element comprised by the device can be provided at the support frame to be pivoted and be carried along thereby. The supporting element can be movable or be moved from an idle position into an operative position, that is, into a position in which the material web is supported on the web side facing away from the cutting tool during severing, by adjusting and/or holding means arranged at the support frame or preferably at the pivoting frame carrying the cutting tool. This can take place by removing a supporting element held releasably in reserve at the support frame by adjusting and/or holding means provided in the roll changer stand or at the pivoting frame. As an alternative, such a supporting element can also be provided at the support frame, for example so as to be movable by adjusting means such that the distance between the supporting element and the axis of rotation of the material roll carrying the web to be cut off can be varied.

A web-fed printing press comprising such a roll unwinder now makes it possible, for example in package or decor printing, to print a material web having a higher strength and/or thickness, as is carried out in one particularly advantageous embodiment, for example, by one or more printing units operating according to a non-impact printing method, and in particular according to an ink jet printing method.

BRIEF DESCRIPTION OF THE DRAWINGS

Exemplary embodiments of the invention are illustrated in the drawings and will be described in greater detail below. The drawings show.

DETAILED DESCRIPTION

Figure 1:
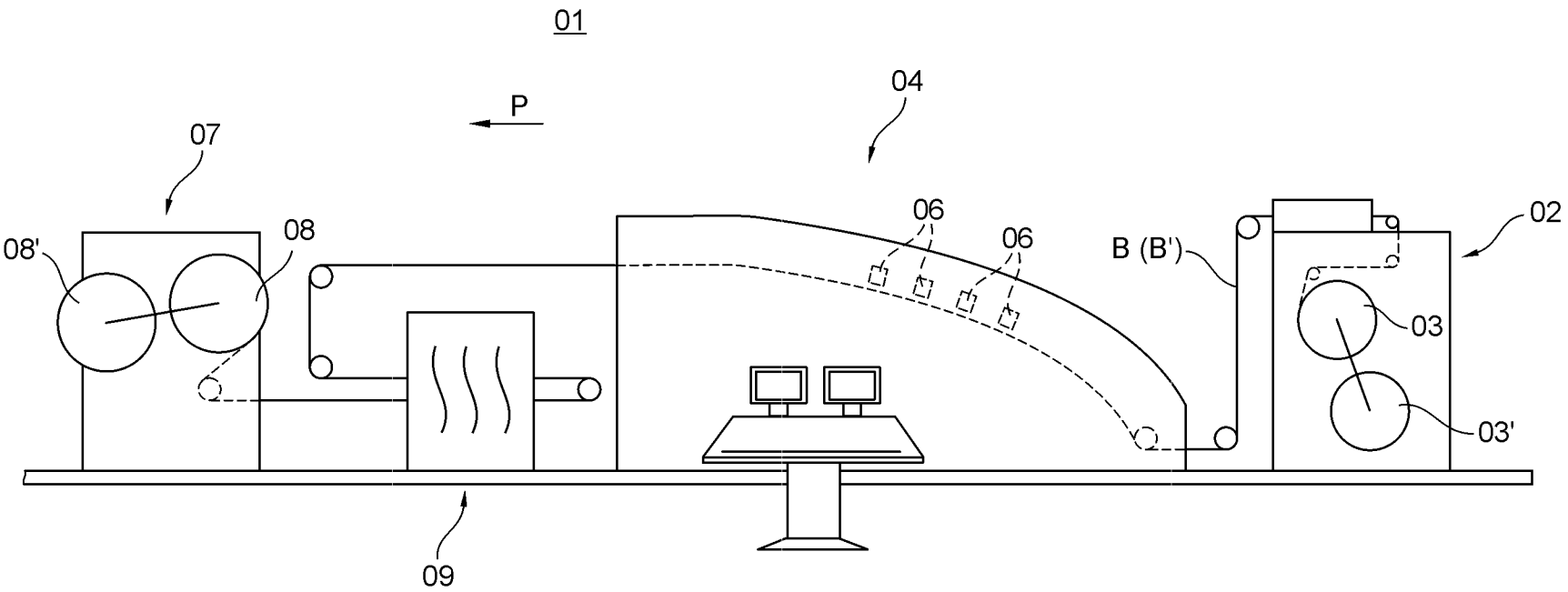
FIG. 1 a schematic illustration of a material web-working and/or material web-processing machine, configured as a web-fed printing press, comprising a roll unwinder.

A material web-working and/or material web-processing machine 01, in particular a web-fed printing press 01, comprises, on the input side, a roll stand 02, for example a roll unwinder 02, unwinder 02 for short, by which a material web B; B' of a material roll 03; 03', for example a printing substrate roll 03; 03', in particular a paper roll 03; 03', roll 03; 03' for short, can be unwound and inserted into the machine 01. The machine 01 can, in principle, be configured as a slitter rewinder machine and only be used to rewind and/or longitudinally cut longitudinal strips. Preferably, however, at least one processing stage 04, for example an embossing unit 04 and/or a film coating unit 04 and/or a laminating unit 04 and/or preferably, however, at least one printing unit 04 are provided in the web path. The machine 01 is preferably configured as a web-fed printing press 01 and comprises at least one processing stage 04, configured as a printing unit 04, for printing the material web B; B' on at least one side.

The material web B; B', for example the printing substrate web B; B' or web B; B' for short, can, in principle, also be configured, for example as a plastic film B; B', as a metal foil B; B' or a composite material. Preferably, however, the material web B; B' is configured as a paper or cardboard web B; B', in particular as a paper or cardboard web B; B' having a grammage of more than 100 g/m$^2$, for example between 100 and 400 g/m$^2$, and/or is made of two or more layers that are joined to one another, for example pressed onto one another while wet during production ("couched"). Such a paper is used, for example, during the production of corrugated cardboard as a linerboard paper. However, the material web can also be formed of cardboard and/or have an even higher grammage.

The input-side roll stand 02 or unwinder 02 is equipped with multiple roll stations and is configured as a roll changer 02, in particular as a roll changer 02 that enables a flying roll change.

Even though the at least one printing unit 04 can, in principle, be configured as an offset printing unit, as a gravure printing unit, or as a letterpress printing unit, it is preferably configured as a printing unit 04 operating according to a non-impact printing method, that is, without a fixed printing forme, and in particular as a printing unit 04 operating in a plateless manner according to a digital printing method. In particular, the web-fed printing press 01 preferably comprises at least one printing unit 04 operating in such a plateless manner, comprising one or, in particular, multiple ink jet print heads 06, that is, for example, at least one ink jet printing unit 04. As a result of the ink jet printing unit 04, a print motif having no fixed repeat length and/or printing patterns having individual and/or changing contents can be printed onto the printing substrate. Particular advantages can be realized in package or decor printing, in particular when printing linerboard facings used during the production of corrugated cardboard or linerboard papers or decorative papers used during the production of laminates.

On the output side of the machine 01, that is, along the material web path downstream from the unwinder 02 and preferably the processing stage 04, in particular the at least one printing unit 04, a continuation to a post-press processing stage, for example to a machine portion for the inline processing of the material web B; B' as a liner of corrugated cardboard to be produced in the machine 01, can be provided. As an alternative, it is possible instead, as shown, for a further roll stand 07 to be provided, by which the material web B; B' can be wound to form a material roll 08; 08', roll 08; 08' for short, forming a wound roll or, in particular, a product roll 08; 08'. The output-side roll stand 07, for example winder 07, is preferably likewise equipped with multiple roll stations and is configured, for example, as a so-called turret winder 07, in particular as a turret winder 07 that enables a flying wound roll change. The material web B; B' passes through the machine 01 between the unwinder 02 and the winder 07 in the horizontal, projected along a production direction P.

To produce a product that is, for example, configured as a corrugated cardboard web, the printed material web B; B', serving as an intermediate product, is additionally also joined in an inline process or in a subsequent processing process to a corrugated web, which may possibly, in turn, be joined to an intermediate liner, in a corresponding post-press processing stage. However, in principle, it is also possible for only the printed material web B; B' to be produced as the product. Within the scope of a production of, for example, a laminate, resin is additionally applied to the printed material web B; B', serving as an intermediate product, in an inline process or in a subsequent processing process, in a corresponding post-press processing stage, and the printed material web is applied onto a substrate material.

In addition to the at least one printing unit 04, it is possible for one or more further printing units 04 and/or other subassemblies 09, for example at least one dryer 09, in particular a radiation dryer 09, to be provided in the printing substrate path.

Figure 2:
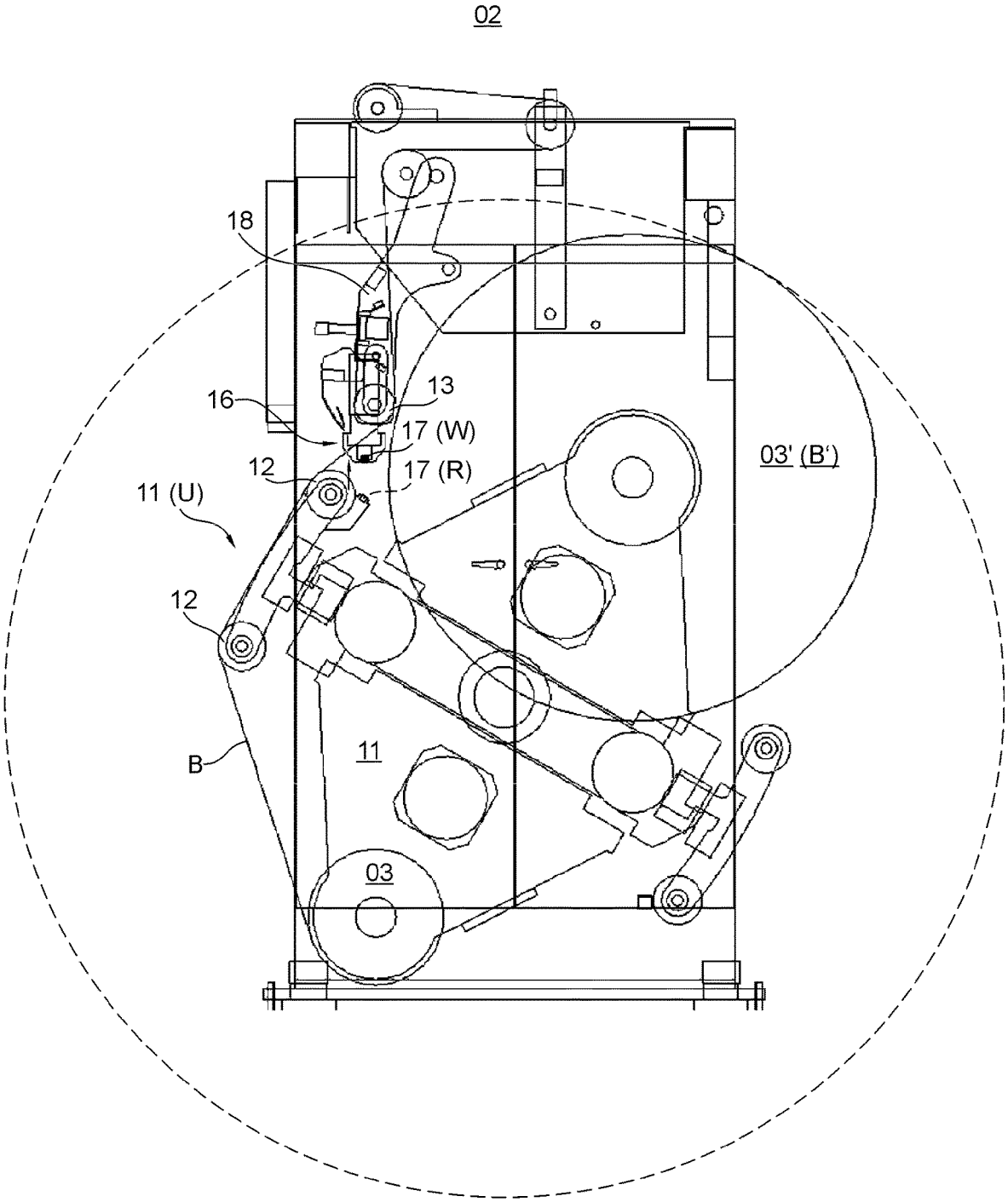
FIG. 2 a roll unwinder comprising a device for supporting the material web to be cut comprising a supporting element that is received at the pasting frame in an operative position.
Figure 3:
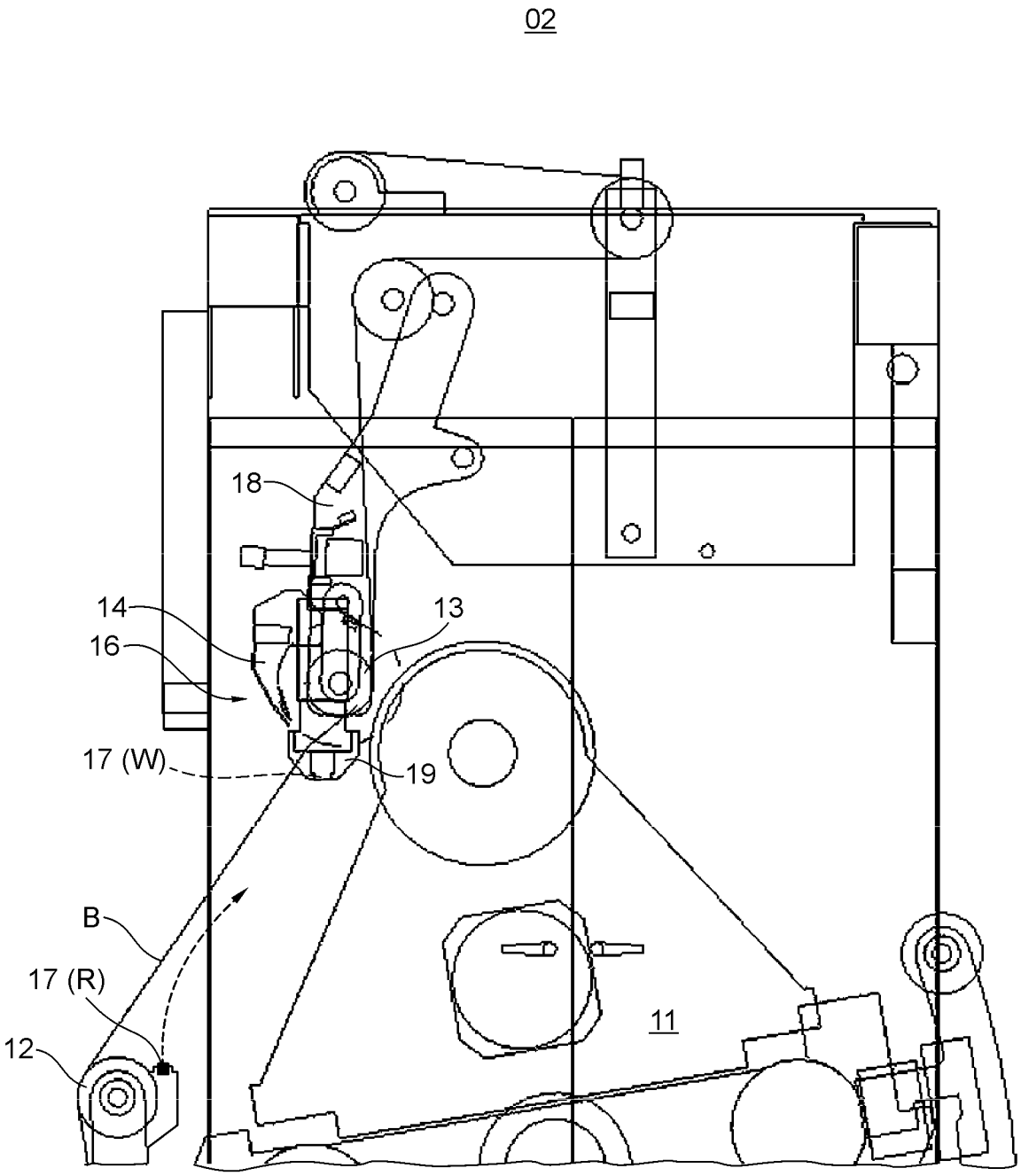
FIG. 3 an enlarged detail of the roll unwinder comprising the device for supporting the material web to be cut comprising a supporting element still positioned in the idle position at the support frame.
Figure 4:
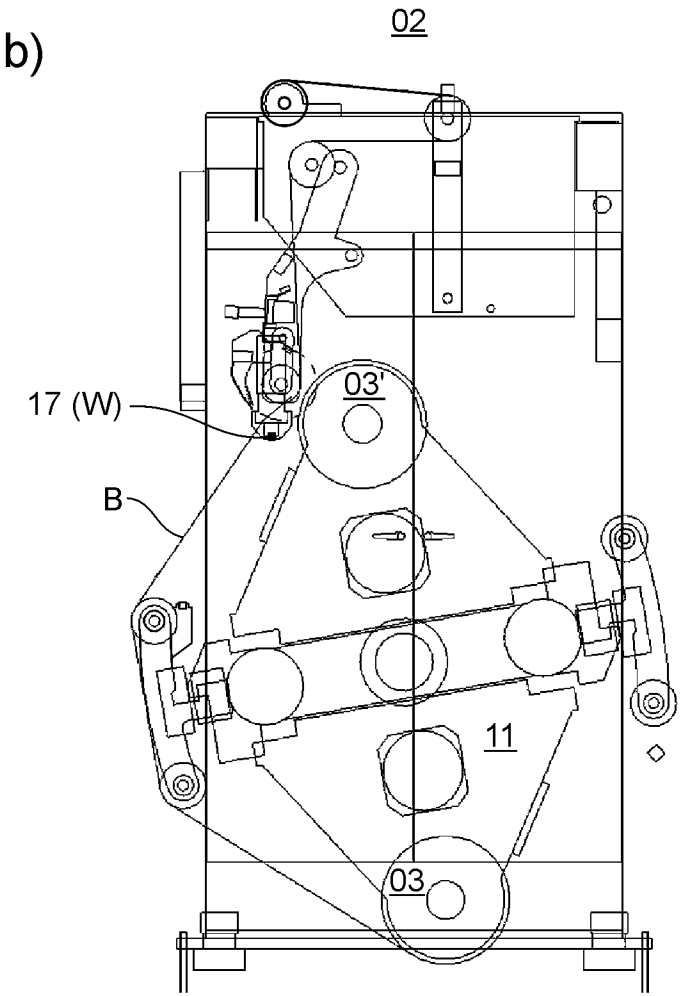
FIG. 4 a schematic illustration of the condition when cutting the old material roll, a) for the case of a new material roll having a large diameter, and b) for the case of a new material roll having a small diameter.
Figure 4:
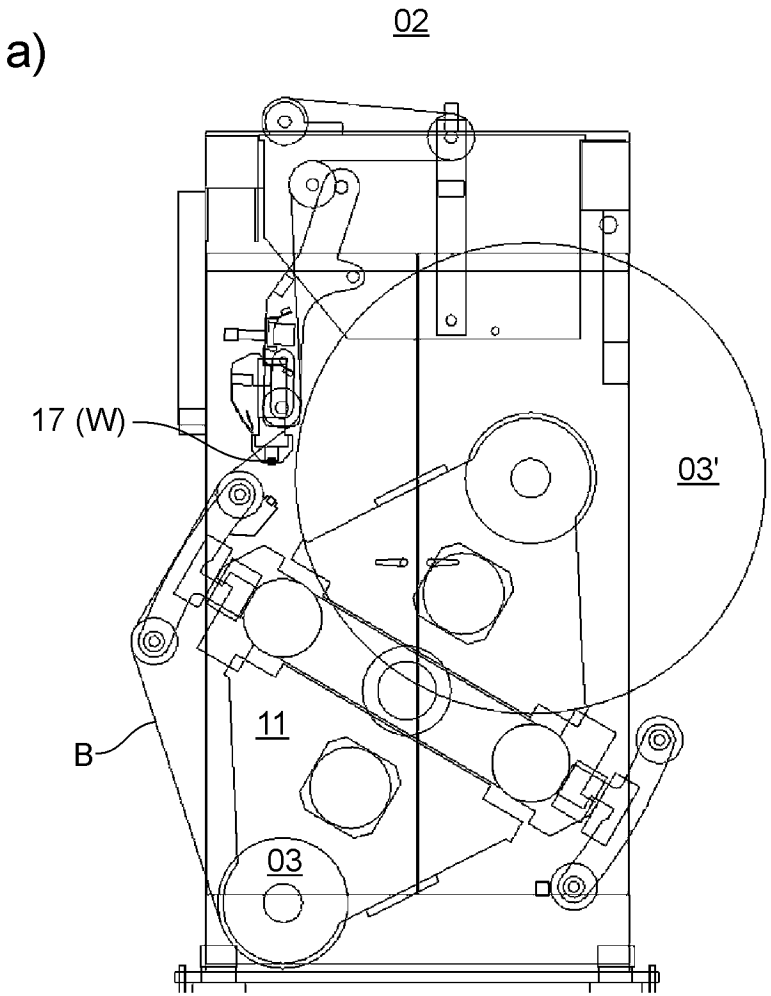

Leading up to a flying roll change, a material web B is currently unwound from the material roll 03 and guided into the machine 01 (see, for example, FIG. 2). If, for example because the current roll 03 has been consumed or for other reasons, the unwinding is to be continued with a new or different material roll 03', the material web B' of the new material roll 03' is brought in contact with the material web B of the material roll 03 currently still unwinding, joined thereto by way of an adhesive, which was previously provided at the material web B', at a splice, and thereupon the material web B still unwound up until this point is severed beyond the splice, that is, for example is cut off or severed. In general, a material web tab, which is not shown here and defined by the web section between the splice and the end of the formerly unwound material web B formed by the severing process, remains at the material web B' of the new material roll 03' that is now to be unwound. For changing the roll, the old roll 03 is displaced into a change-out position, in which the circumference of the new roll 03' and the web B of the old roll 03 are situated in an adjoining position with respect to one another, by pivoting a subframe 11 carrying the at least two rolls 03; 03', which is usually also referred to as a support frame 11. In an embodiment described below for keeping a supporting element 17, described there in greater detail, available at the support frame 11, the support frame 11, before being transferred into the change-out position, is pivoted into a transfer position U (see, for example, the dotted arrow in FIG. 3) in which the supporting element 17 can be received in the manner described below. The rolls 03; 03' are received at the end face, for example, by cones mounted rotatably at the support frame 11.

FIG. 2 shows, with dotted lines, the circumscribing circle that theoretically results by pivoting of the largest possible roll 03; 03' to be loaded in the roll unwinder 02. The web 03 to be severed is, or is being, guided over one or more diverting rollers 12, for example, before they reach the exposure zone of and/or make contact with a pressing element 13, for example on the circumference of a pressing element 13 configured as a pressing roller 13. The pressing element 13 configured, for example, as a pressing brush 13 or a pressing roller 13 can be placed against the outer surface of the new roll 03' that has been moved, in particular pivoted, into the roll change position, thereby pressing the web B that has been unwound thus far against the outer web layer of the new roll 03'. A cut-off tool 14, configured, for example, as a cutting blade 14, in particular a severer 14, can be moved by drive means, which are not denoted in detail here, into the web path between the pressing element 13 and the next upstream or only diverting roller 12, whereby the web B is severed.

The invention will be described in subsequent embodiments using the pressure roller 13, but can likewise be applied to other embodiments of pressing elements 13, in particular also to pressing brushes 13 or the like.

So as to now ensure secure and clean severing, for example also for material webs B; B' made of a thicker and/or stronger material and/or for differing roll diameters, a device 16, which can, in particular, be transferred from an idle state into a working state, for supporting the material web B; B' to be severed, supporting device 16 for short, is provided, which can be transferred into a working state in which the web B; B' is supported in the area of the web path between the pressing roller 13 and the roll 03 to be unwound, in particular the next upstream or only diverting roller 12. The device can be provided so as to support the web B in the web path generally downstream, upstream or even in the area of the location at which the cut-off tool 14, when activated, strikes the web B. According to the invention, however, this is provided upstream as viewed from this location.

The device 16 comprises a supporting element 17, which can be moved or is moved from an idle position R, which is assumed in the idle state of the device 16, into an operative position W, which is assumed in the working state of the device 16. In the latter position, the supporting element is preferably situated in a relative position, which differs from the idle position R, with respect to the axis of rotation of the first material roll 03 or in particular in a position in which the web B is supported in the web path section between the pressing roller 13 and the material roll 03, or between the pressing roller 13 and, if present, a next or only diverting element 12 that is possibly provided upstream from the pressing roller 13, between the pressing roller and the material roll 03, in particular a provided diverting roller 12, on the web side facing away from the cut-off tool 14, during the severing process. A surface, facing the web B, of the supporting element 17, which is in the operative position W, can already make contact with and support the web B, or may just barely not make contact therewith, that is, be spaced apart at a slight distance, for example no more than 5 mm, prior to the cut-off process and can only support the web B during the cut-off process by way of the severer 14. In the idle position R, the supporting element 17 is furthermore arranged more than 10 mm, for example, from the web path.

In the operative position W, for the case of one or more additional guide elements, which are fixed to the support frame, the supporting element 17, as viewed along the web progression, is located closer to the site at which the cut-off tool 14 strikes the web B, and/or is located further away from the axis of rotation of the first material roll 03 than the diverting roller 12, which is possibly fixed to the support frame, or possibly one or more further guide elements which are fixed to the support frame, for example guide rollers.

The supporting element 17 is preferably arranged so as to be movable, that is, movable relative to the axis of rotation of the material roll 03 to be cut, or in the idle position R is preferably arranged releasably at the support frame 11. In the first case, the supporting element can, for example, be movably arranged at the support frame 11 and be adjustable between the idle and operative positions R; W by a servo drive. In the preferred embodiment shown here, however, a receiving unit 19 is provided at a frame 18, which carries the cut-off tool 14 and is preferably movably mounted in the stand of the roll unwinder 02, which is also referred to, for example, as a pivoting frame 18 or a pasting frame 18, it being possible for the supporting element 17, which is releasably arranged at the support frame 11, to be received by the receiving unit for an impending roll change and to be moved into the operative position W together with the severer 14 and its actuator, pivoting frame 18 and/or relative thereto by a further adjusting means. If necessary, for example, the support frame 11 is initially pivoted into a transfer position U in which the supporting element 17 can be received with the aid of the receiving unit 19. In an advantageous embodiment, the receiving unit 19 is formed by a support and/or gripper device 19 provided at the frame 18, for example a gripper system 19 carried along at the frame 18, which can be moved, for example by positioning of the frame 18 and/or by adjusting means, which are not shown, into a receiving position in which the receiving unit is able to receive the supporting element 17 mounted at the support frame 11. In the operative position W, the positioning then likewise takes place, for example, via the positioning of the frame 18 and/or additional adjusting means relative to the frame 18. In this preferred embodiment, the supporting element 17 is thus positioned in the idle position R at the support frame 11 during the normal operation, and is moved into the operative position W, here, for example, from beneath against the material web B, during the course of the roll change via the receiving unit 19.

In addition to the cut-off tool 14 and its actuator as well as the receiving unit 19, the frame 19 can also carry the aforementioned pressing roller 13 and/or be movable, in particular pivotable, in the stand of the unwinder 02 toward the web path section to be served and away therefrom.

Although the disclosure herein has been described in language specific to examples of structural features and/or methodological acts, it is to be understood that the subject matter defined in the appended claims is not necessarily limited to the specific features or acts described in the examples. Rather, the specific features and acts are disclosed merely as example forms of implementing the claims.

The invention claimed is:

1. A roll unwinder (02) for a flying roll change, comprising at least one roll station for receiving a first material roll (03) currently to be unwound and a roll station for receiving a second material roll (03') to be unwound after a roll change has occurred, comprising a cut-off tool (14) by which a first web (B) unwound from the first material roll (03) can be severed, and comprising a pressing element (13), by which the first web (B) currently to be unwound can be pressed against an outer surface of the second material roll (03'); a supporting device (16) being provided, which can be transferred from an idle state into a working state in which the supporting device (16) supports the web (B) currently to be unwound, at least at the time of the severing process, in the area of the web path at a site that is situated in the web path between the first material roll (03) to be unwound and the location at which the pressing element (13) cooperates with the web (B); the supporting device (16) comprising a supporting element (17), which can be moved from an idle position (R), which is assumed in the idle state of the supporting device (16), into an operative position (W), which is assumed in the working state of the supporting device (16), in which the supporting element (11) is situated in a relative position, which differs from the idle position (R), with respect to an axis of rotation of the first material roll (03) and/or is situated in a position in which the web (B) is supported in the web path section between the pressing element (13) and the material roll (03) or a diverting element (12) that is provided upstream from the pressing element (13), on the web side facing away from the cut-off tool (14), during the severing process; the supporting element (17), in the idle position (R), being releasably arranged at a pivotable support frame (11) carrying the first and second material rolls (03; 03'); the supporting device (16) being provided so as to support the web (B) in the working state in the web path upstream from the location at which the cut-off tool (14), when activated, strikes the web (B), and a receiving unit (19) being provided at a frame (18), which carries the cut-off tool (14) and is movably mounted in a stand of the roll unwinder (02), wherein the supporting element (17), which is releasably arranged at the support frame (11), is received by the receiving unit for an impending roll change.

2. The roll unwinder according to claim 1, characterized in that, in the operative position (W), the supporting element (17), as viewed along the web progression, is located closer to the site at which the cut-off tool (14) strikes the web (B), and/or is located further away from the axis of rotation of the first material roll (03) than a diverting element (12) that is fixed to the support frame.

3. The roll unwinder according to claim 1, characterized in that the receiving unit (19) can be moved into a receiving position by positioning of the frame (18) and/or by adjusting a position of the receiving unit (19) relative to the frame (18).

4. The roll unwinder according to claim 1, characterized in that the supporting element (17) is arranged so as to be able to undergo a relative movement at the support frame (11) such that a distance between the supporting element (17) and an axis of rotation of the first material roll (03) carried at the support frame (11) can be varied.

5. The roll unwinder according to claim 1, characterized in that, in the operative position (W), the supporting element (17) is arranged so as to make contact with a web (B) guided in the web path or is arranged at a distance of no more than 5 mm from the web path progression and/or that, in the idle position (R), the supporting element (17) is spaced more than 10 mm apart from the web path progression.

6. The roll unwinder according to claim 1, characterized in that the supporting element (17) supports the web (B) currently to be unwound in the operative position (W), at least at the time of the severing process, at a site in the web path situated between the material roll (03) to be unwound and the location in the web path at which the cut-off tool (14) strikes the web (B).

7. The roll unwinder according to claim 1, characterized in that the pressing element (13) is configured as a pressing roller (13).

8. A web-fed printing press (01), comprising at least one printing unit (04), by which a material web (B; B') can be printed at least on one side in a plateless manner according to a digital printing method, and comprising an unwinder (02), which is arranged upstream from the printing unit (04) in the material web path and by which the material web (B; B') to be printed can be unwound from a material roll (03; 03'), the unwinder (02) being configured to receive at least two material rolls (03; 03') and to carry out a flying roll change, characterized by the roll unwinder (02) according to claim 1.

9. A method for operating a roll unwinder (02) that can be operated with a flying roll change; the material web (B) of a roll (03) that is currently being unwound being pressed by a pressing element (13) against an outer surface of a rotating second material roll (03') adhered to the material roll (03) currently being unwound; before the material roll (03) currently being unwound being cut off by means of a cut-off tool (14), a supporting element (17) of a supporting device (16) being moved from an idle position (R) into an operative position (W) in which the web (B) is supported in the web path section between the pressing element (13) and the material roll (03) on the web side facing away from the cut-off tool (14), characterized in that the supporting element (17) is moved into positions having differing distances with respect to an axis of rotation of the respective first material roll (03) for differently large first material rolls (03).

10. The method according to claim 9, characterized in that the supporting element (17), from the idle position (R), in which the supporting element (17) is releasably arranged at a support frame (11) carrying the two material rolls (03; (03'), is initially received by a receiving unit (19), which is arranged at a frame (18) carrying the cut-off tool (14).

11. The method according to claim 10, characterized in that, in the operative position (W), the positioning of the supporting element (17) takes place via the positioning of the frame (18) and/or via adjusting a position of the support element (17) relative to the frame (18).

* * * * *